US005569327A

United States Patent [19]

Paradis et al.

[11] Patent Number: 5,569,327

[45] Date of Patent: Oct. 29, 1996

[54] ENVELOPE FLAT MOISTENER

[75] Inventors: Jason P. Paradis, West Haven; Steven A. Supron, Prospect, both of Conn.

[73] Assignee: Pitney Bowes Inc., Stamford, Conn.

[21] Appl. No.: 387,547

[22] Filed: Feb. 13, 1995

[51] Int. Cl.[6] ..... B05C 1/00

[52] U.S. Cl. ..... 118/253; 118/268; 156/441.5

[58] Field of Search ..... 118/694, 712, 118/253, 264, 265, 266, 267, 268; 156/305, 308.6, 308.8, 441.5, 546, 578, 442.1

[56] References Cited

U.S. PATENT DOCUMENTS

| | | | |
|---|---|---|---|
| 2,035,376 | 3/1936 | Gautier | 118/253 |
| 4,380,209 | 4/1983 | Reid et al. | 118/253 |
| 4,380,210 | 4/1983 | Auerbach | 118/253 |
| 4,428,794 | 1/1984 | Hayskar et al. | 156/422.1 |
| 4,450,037 | 5/1984 | Gavronsky | 156/441.5 |
| 4,643,123 | 2/1987 | Auerbach | 118/268 |
| 4,773,962 | 9/1988 | Garrigue et al. | 156/441.5 |
| 5,006,194 | 4/1991 | Schmaling | 156/442.1 |
| 5,156,048 | 10/1992 | DeFigueiredo et al. | 73/308 |
| 5,354,407 | 10/1994 | Hubbard et al. | 156/442.1 |
| 5,466,327 | 11/1995 | Staniszewski | 156/442.1 |

*Primary Examiner*—Laura Edwards

*Attorney, Agent, or Firm*—Ronald Reichman; Melvin J. Scolnick; Brigitte Jeffery

[57] ABSTRACT

This invention is directed to an envelope flap moistener that comprises a frame for supporting the moistener and an elongate substantially rectangular-shaped base removably connected to the frame. The base has a fluid outlet aperture and a plurality of pockets located at spaced intervals longitudinally across the base. The moistener has a plurality of brushes capable of upwardly transferring fluid by capillary action. The plurality of brushes include means for slidably engaging the plurality of brushes within the plurality of pockets located in the base. A cover is mounted onto the base. The cover has a fluid inlet aperture and a plurality of openings for exposing the plurality of brushes.

17 Claims, 6 Drawing Sheets

ENVELOPE FLAT MOISTENER

BACKGROUND OF THE INVENTION

The present invention relates to an apparatus for moistening the closure flap of an envelope during automatic mail handling.

In mail handling machines, moistening devices are used to wet the flap of an envelope in preparation for sealing the envelope. Conventionally, this wetting is done by feeding the envelope past a stripper blade having a moistening brush attached thereto, which allows the wet brush to come into contact with the glue on the envelope flap. The water causes the glue to soften and become tacky to the touch. The envelope is then fed between two sealing rollers which press the flap against the envelope body to form the seal. The envelope is then either ejected into a stacker or passed on to another part of the mail handling machine for further processing.

As shown in U.S. Pat. No. 4,380,210 for a Workpiece Moistening System, issued Apr. 19, 1983 to David Auerbach and assigned to the assignee of the present invention, it is known in the art to manually move a plate over the moistening device to selectively dispense a "dry" or "wet" envelope. Moreover, as shown in U.S. Pat. No. 4,380,209 for a Workpiece Moistening Apparatus, issued Apr. 19, 1983 to Robert R. Reid, et al, and assigned to the assignee of the present invention, it is known in the art to provide moistening structure comprising a brush including a base with a plurality of teeth and bristles extending from the base. The bristles have a free end for contacting and applying moisture to an envelope. A brush holder also includes a plurality of teeth for slidable engagement with the brush teeth.

Typically, the moistening device includes a reservoir for introduction of water or a similar fluid into the moistening apparatus. The fluid level in the reservoir must be maintained above a minimum level to ensure that a suitable amount of moisture is applied to the envelope flap. In some cases, visual observation of the water in the reservoir may be possible if the reservoir tank is transparent or contains a transparent window which allows observation of the water level. In other cases, the reservoir is situated in the moistening apparatus such that observation is not possible. In general, even when the water level is observable, some form of fluid level detection is required to prevent the water level from inadvertently falling below the minimum level.

As shown in U.S. Pat. No. 5,156,048 for an Electronic/Magnetic Apparatus and Method for Detecting Fluid Level, issued Oct. 20, 1992 to Carlos L. DeFigueiredo, et al, and assigned to the assignee of the present invention, it is known in the art to combine the use of one or more Hall effect sensors and a float containing two magnets in push-pull configuration to provide an accurate, low cost system of fluid level detection.

Notwithstanding the aforesaid prior art, there has been a long felt and as yet unsatisfied need to provide an envelope flap moistener wherein the flap moistening apparatus is constructed and arranged for appropriately, but not excessively, wetting the envelope flaps.

SUMMARY OF THE INVENTION

The present invention is directed to an envelope flap moistener that satisfies the aforementioned needs. An envelope flap moistener having features of the present invention comprises a frame for supporting the moistener and an elongate substantially rectangular-shaped base removably connected to the frame. The base has a fluid outlet aperture and a plurality of pockets located at spaced intervals longitudinally across the base. The moistener has a plurality of brushes capable of upwardly transferring fluid by capillary action. The plurality of brushes include means for slidably engaging the plurality of brushes within the plurality of pockets located in the base. A cover is mounted onto the base. The cover has a fluid inlet aperture and a plurality of openings for exposing the plurality of brushes. The cover includes a substantially horizontal first shaft extending longitudinally across the cover. A shield is rotatably mounted onto the first shaft. The shield has a first plurality of fingers which extend substantially horizontally between the plurality of brushes. The moistener has holding means for holding the shield in a substantially horizontal position and a substantially rectangular-shaped deflector disposed above the shield. The deflector has a second plurality of fingers interconnected by an edge bar and oppositely-spaced end walls, each end wall has an aperture. The moistener has rotating means for rotating the deflector towards the shield. A second shaft extends through the aperture in each end wall. The second shaft is rotatably mounted onto the frame.

DESCRIPTION OF THE PREFERRED EMBODIMENT

Figure 1:
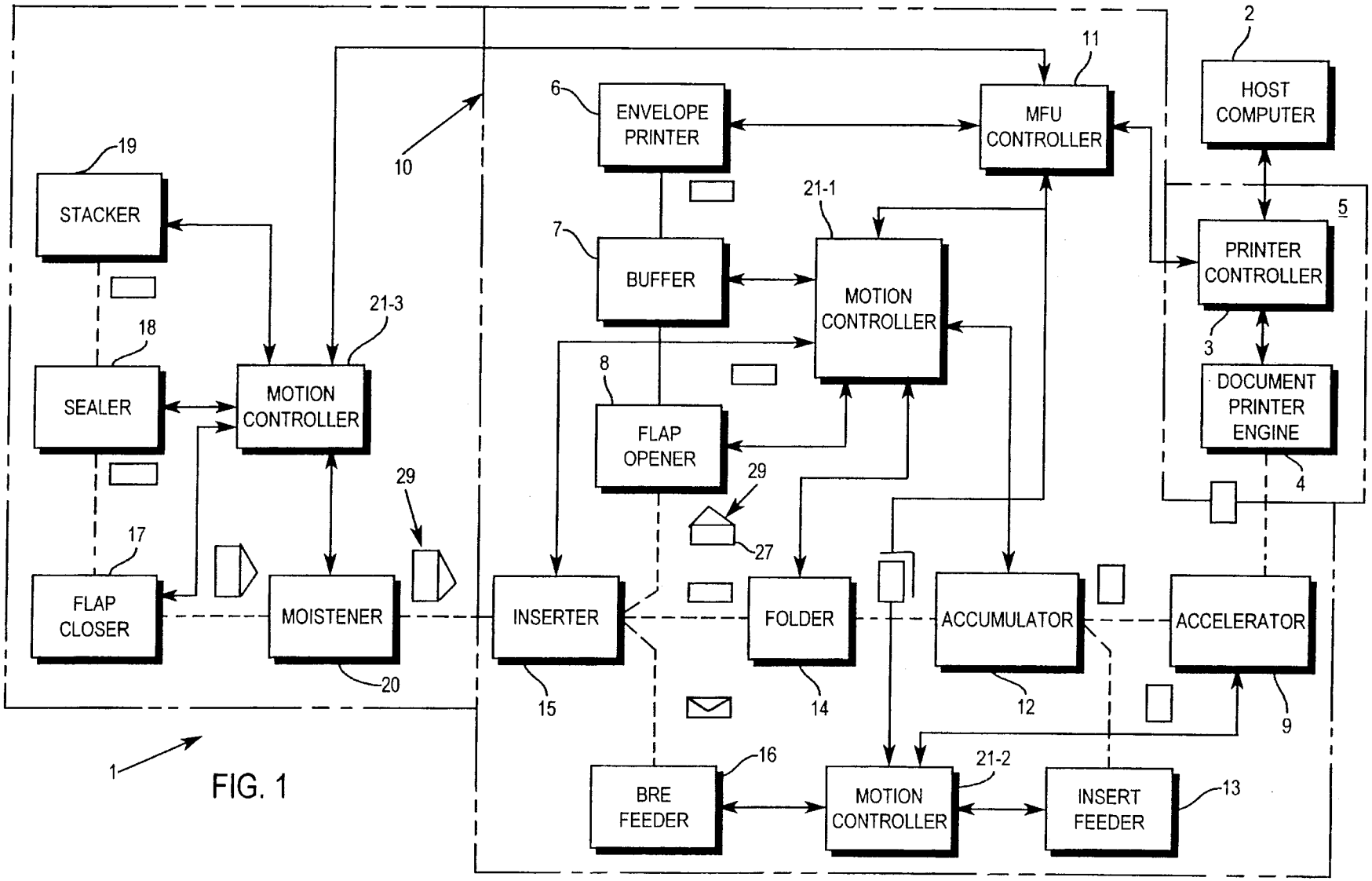
FIG. 1 is a schematic block diagram of an apparatus in accordance with the subject invention.

As shown in FIG. 1, a mailing machine 1 of the type which may be s modified in accordance with the invention generally is connected to a host computer 2 to receive data for controlling the mailing machine 1. A preferred embodiment of the mailing machine 1 is described in commonly assigned, co-pending U.S. patent application Ser. No. 08/364,365, filed Dec. 27, 1994, which is hereby incorporated by reference.

The mailing machine 1 includes a document printer 5, which is preferably a laser printer including printer controller 3 and a conventional document printer engine 4, and a mail finishing unit 10 which receives the printed documents from printer engine 4 and inserts them into an envelope 29 to form a mail piece. The operation of the mailing machine 1 is controlled in part by motion controllers 21-1, 21-2, and 21-3.

Printer controller 3 receives job data from host computer 2 and sends data to the mail finishing unit controller 11 and the document printer engine 4. Envelope printer 6 includes an integral controller which will render the text characters received from the mail finishing unit controller 11 into appropriate control signals to render an image of a mailing address.

Envelope printer 6 is preferably an ink jet printer and the printed envelopes are output from printer 6 to a drying buffer station 7. After the printed address has dried on the envelope 29, the envelope 29 proceeds to flap opener station 8 where the envelope flap 27 is opened prior to insertion of the printed documents from document printer 5.

When drying buffer 7 is loaded, printer controller 3 outputs a page of document data to document printer engine 4 which prints that page in a conventional manner. As the page is printed, it is received by accelerator station 9, and as printer engine 4 releases the printed page, accelerator station 9 accelerates the page to the faster speed at which mail finishing unit 10 operates.

Accelerator station 9 then transfers the printed page to accumulator station 12. Preprinted inserts may be fed from insert feeder to accumulator station 12. Once completed, the accumulation of printed document pages and any preprinted inserts are transferred from accumulator station 12 to folder station 14 where the accumulation is folded. Once the folded accumulations is present at folder station 14, the envelope 29, with its flap 27 open, is fed to inserter station 15 and the folded accumulation is transferred from folder station 14 to inserter station 15 for insertion into the envelope. If necessary, a business reply envelope BRE is fed from feeder 16 and also inserted into the envelope 29.

The mail piece is then fed from inserter station 15 to moistener station 20 where the envelope flap 27 is moistened if the mail piece is to be sealed. The mail piece then proceeds to flap closer station 17, sealer 18, and output stacker 19 where the completed mail piece is output for franking with the proper postage and delivery to the postal service.

Figure 2:
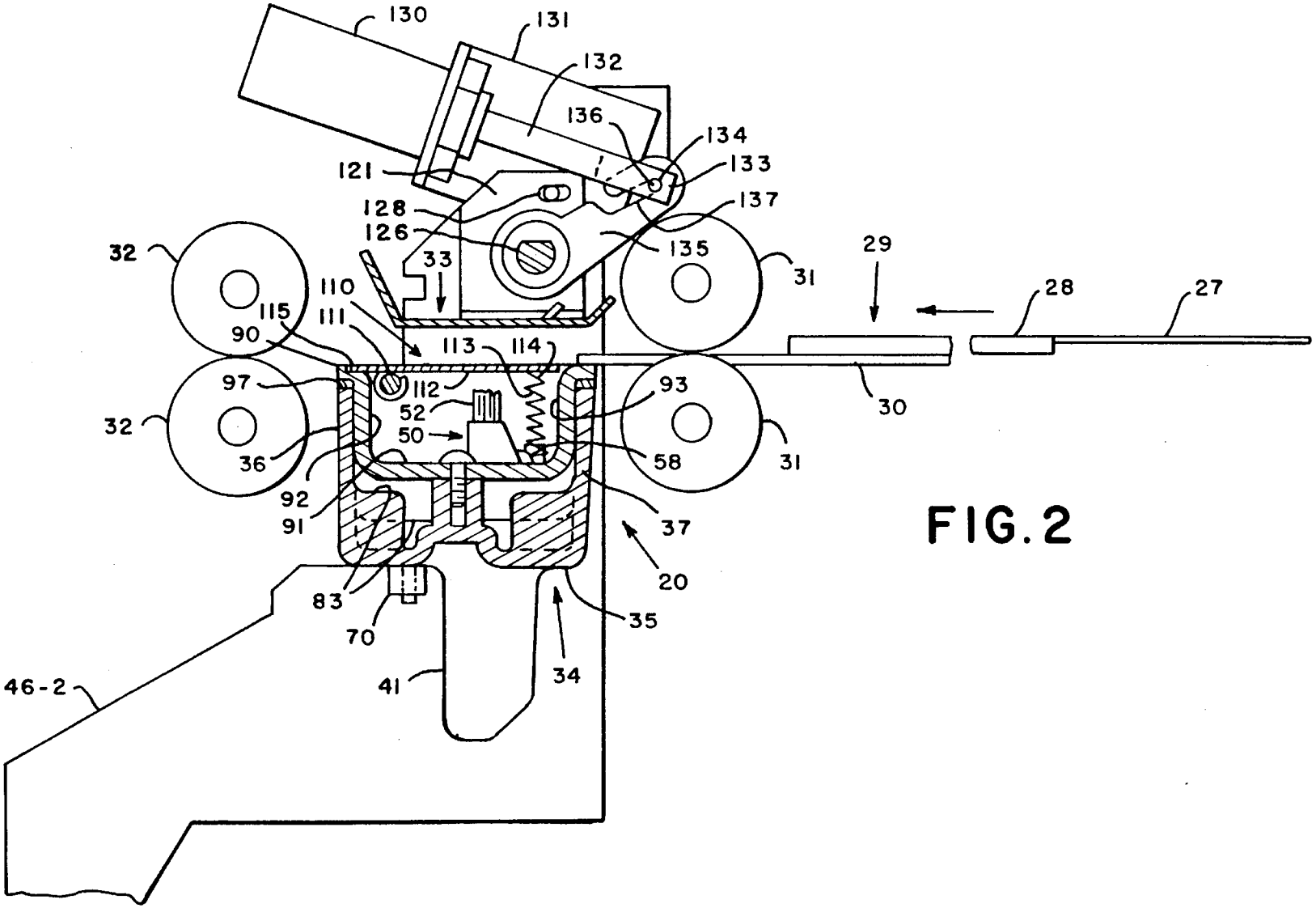
FIG. 2 is a side elevational view of the envelope flap moistening device showing the deflector in home position.

As shown in FIG. 2, a mailing machine 1 in accordance with the invention generally includes a feed deck 30 and first pair of feed rollers 31 for driving an envelope 29 toward the moistening apparatus 20 in the direction shown by the solid line arrow of the drawing. An envelope 29 is fed with the envelope body 28 leading and an open flap 27 forming the trailing edge of the envelope 29. A suitable envelope transport 32, which may be one or more belts or a second pair of feed rollers, is provided downstream to receive the envelope 29 discharged by the moistener 20 and advance the envelope 29 forward. If a mailing machine 1 does not have a moistening apparatus 20, the mailing machine 1 may be fitted with a device in accordance with the invention by installing a kit which consists of the parts comprising the moistener apparatus 20 disposed trader the path of travel along with driving means such as a solenoid, air cylinder, cam, or other suitable driver, for driving a deflector 33 into or out of the path of envelope 29 movement.

Figure 3:
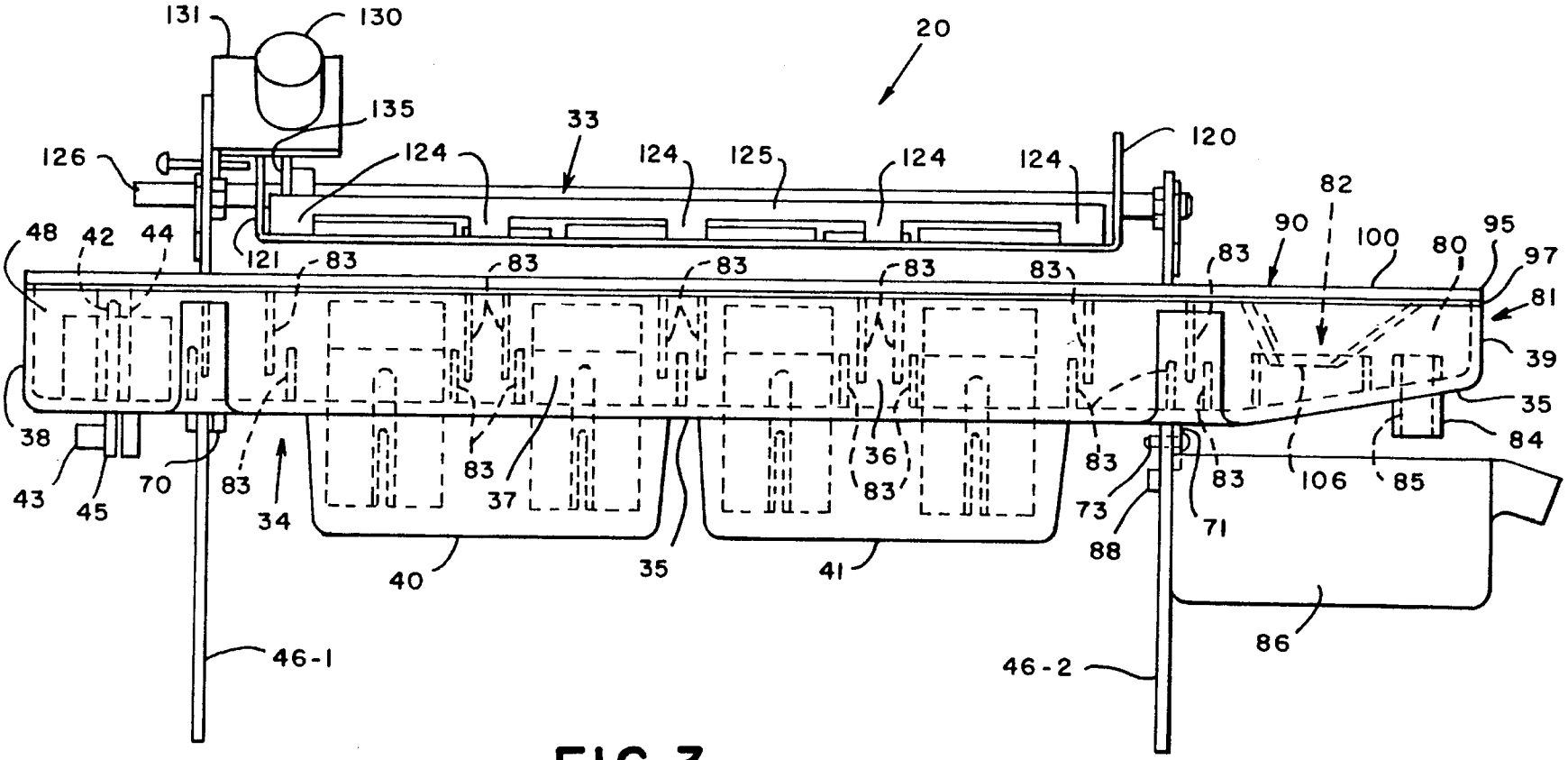
FIG. 3 is a front elevational view of the envelope flap moistening device.

Referring to FIG. 3, the envelope flap moistening structure 20 includes an elongate, substantially rectangularly-shaped base 34 which holds a supply of moistening fluid, preferably water or water including an anti-bacterial agent. In a preferred embodiment, the base 34 holds at least 250 ml of moistening fluid. The base 34 has an elongate, substantially rectangularly-shaped base wall 35, a pair of elongate substantially rectangularly-shaped side walls 36, 37, and a pair of end walls 38, 39 extending between the side walls 36, 37. The end walls 38, 39 and side walls 36, 37 extend upwardly from the base wall 35.

The base 34 includes a rearwardly disposed, generally horizontally-extending section 48. The rearwardly extending section 48 includes a sleeve 44 and a prior art float assembly slidably mounted over sleeve 44. A float assembly suitable for use in an envelope flap moistener is disclosed in U.S. Pat. No. 5,156,048 for an Electronic/Magnetic Apparatus and Method for Detecting Fluid Level, issued Oct. 20, 1992 to Carlos L. DeFigueiredo, et al, and assigned to the assignee of the present invention, and incorporated herein by reference. A printed circuit board 45 sits within the cavity 42 of the sleeve 44 which protects the circuit board 45 from the fluid in the base 34. The circuit board 45 has mounted thereon a Hall sensing device (not shown) for detecting low fluid level. The circuit board 45 has a connector 43 at its end extending out of the sleeve 44 for applying power and receiving signals from the Hall sensing device (not shown).

A plurality of pockets 40, 41 are integrally formed with the base wall 35 to define an elongate rectangularly-shaped receptacle for carrying a moisture applicator device. According to the invention, the plurality of pockets 40, 41 are dimensioned for carrying a prior art moisture applicator.

Figure 5:
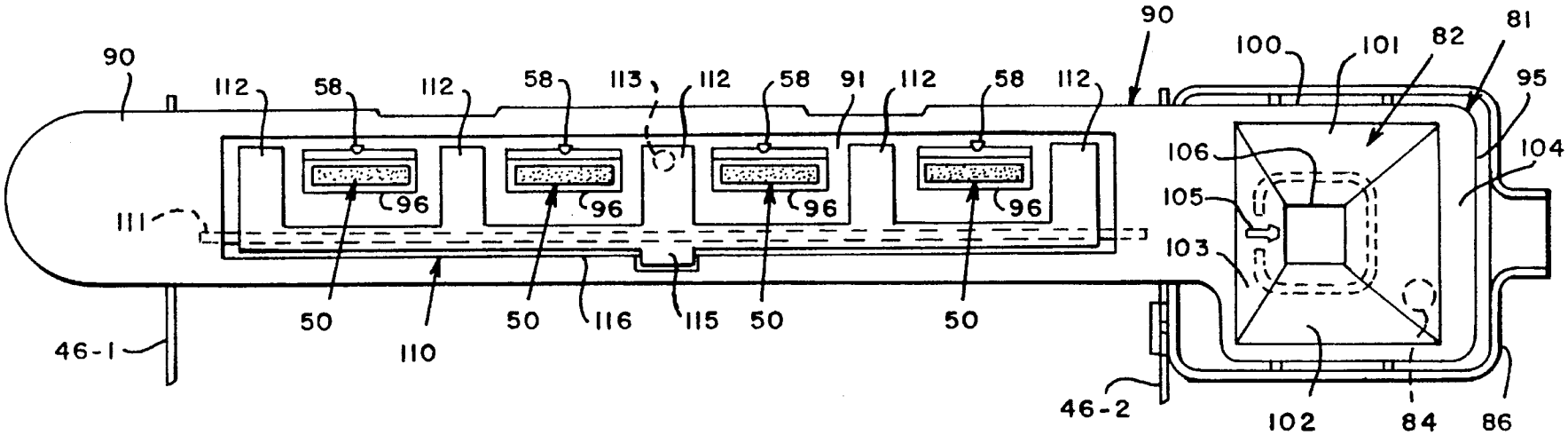
FIG. 5 is a top plan view of the envelope flap moistening device.
Figure 6:
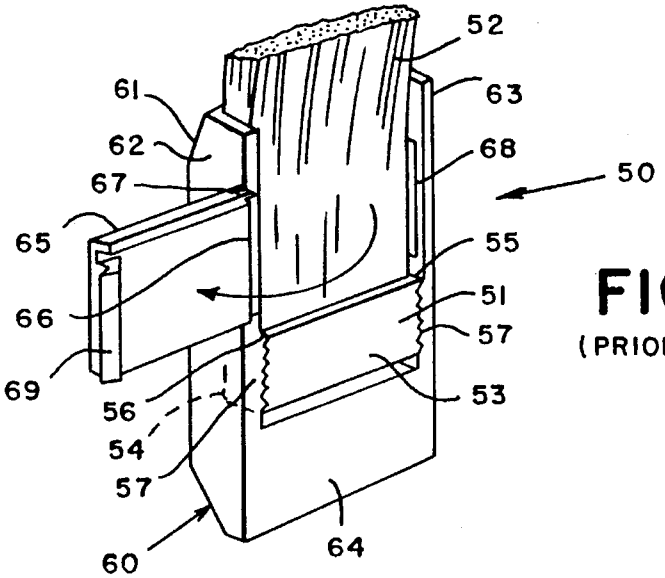
FIG. 6 (PRIOR ART)
FIG. 6 is an enlarged, perspective view of the moistening brash.

Referring to FIG. 6, the prior art applicator includes an elongate brush 50 and a brush holder 60 in the form of a housing 60. The brush 50 includes a base 51, which is preferably made of a resilient plastic material, such as polypropylene, and includes a moisture carder which is preferably a plurality of bristles 52 which are held in place by the base 51. The brush base 51 has an oppositely-spaced front wall 53 and rear wall 54 and oppositely spaced side walls 55, 56. Each of the side walls 55, 56 has formed therein a plurality of parallel-spaced teeth 57 for adjusting the height of the plurality of bristles 52. The housing 60, which is preferably made of a resilient plastic material, such as polypropylene, includes a rear wall 61, oppositely-spaced side walls 62, 63 and a front wall 64. The front wall 64 comprises a door 65 which is integrally hingedly attached to one of the side walls 62, 63 by means of a vertically-extending, flexible, hinge portion 66 of the housing, at the intersection between the front wall 64 and one of the side walls 62, 63. The hinge portion 66 is formed by molding a vertically-extending slot 67 at the aforesaid intersection. With this arrangement, the front wall 64 is pivotally movable about a vertical axis defined by the plastic material from which the housing 60 is made. The housing's side wall 62, 63 opposite the hinge 66 has formed therein an aperture 68. The vertically-extending, free side edge of the front wall 64 has integrally formed therewith a latch portion 69. The latch portion 69 is dimensioned relative to the aperture 68 such that the latch portion 69 is insertable into, and removable from, the aperture 68 against the resilient forces exerted on the latch portion 69 by the walls of the aperture 68. The rear wall 61 has formed therein an opening for fluid flow communication therethrough. The cover 90 has a tab 58 (see FIG. 5) for holding the brush 50 into engagement with the base side wall 36, 37.

Figure 4:
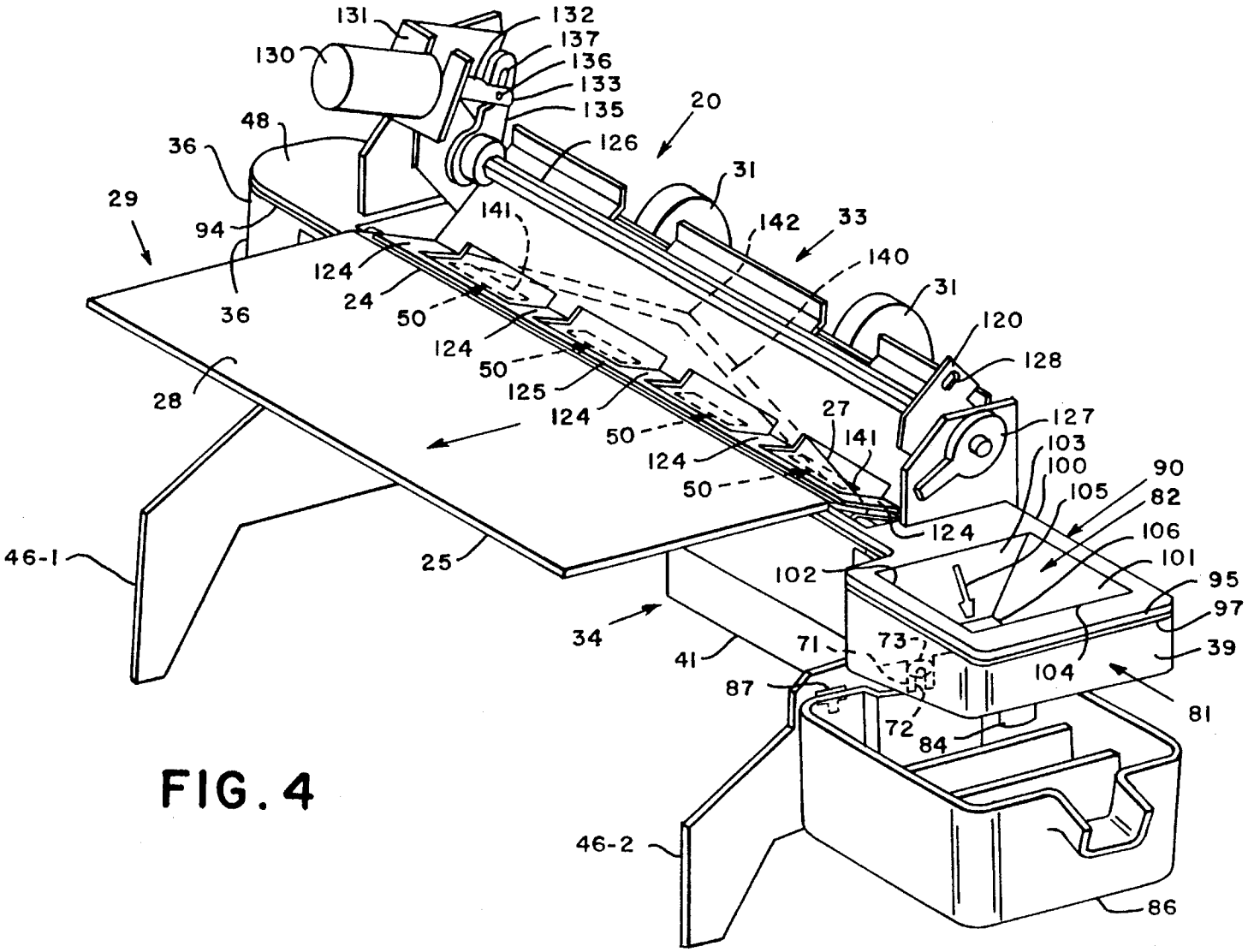
FIG. 4 is a perspective view of the envelope flap moistening device.

Referring to FIGS. 3 and 4, the mailing machine 1 generally includes a frame 46-1, 46-2 for supporting the various components of the moistening apparatus 20. The base 34 is mounted directly onto the frame 46-1 by sliding the base 34 to insert a key 70 into a cut-out slot on one side of the frame 46-1 while resting a flange 71 having a U-shaped notch 72 onto a screw 73 engaged with frame 46-2. The base 34 is then held in place between the frame 46-1, 46-2 and can be easily removed.

The base 34 includes a forwardly disposed, generally horizontally-extending section 81. The forwardly disposed section 81 includes a well 80 for receiving a fluid. The well 80 has a generally rectangularly-shaped opening 82 in fluid-flow communication with the interior of the base 34. Incoming fluid will flow within base 34 from the forwardly disposed section 81 towards the rearwardly disposed section 48. A plurality of baffles 83 extend upwardly from the base wall 35. The plurality of baffles 83 fall below the surface level of the fluid when the base 34 is filled with fluid. The baffles 83 thwart the transverse movement of the fluid which occurs as the moistener 20 is moved.

The well 80 includes a generally cylindrically-shaped depending wall 84 which extends downwardly from the base wall 35 thereby defining a generally circularly-shaped fluid outlet opening 85 for guiding fluid overflow from the well 80.

An overflow reservoir 86 is disposed beneath and in fluid-flow communication with the fluid outlet opening 85. Frame 46 has a plurality of T-shaped openings 87 for mounting the reservoir 86. Further, the overflow reservoir 86 has a plurality of T-shaped ridge portions 88 which are complementarily configured to permit the overflow reservoir 86 to be longitudinally slidably mounted through openings 87 and onto frame 46-2.

The moistener 20 includes an elongate, substantially rectangularly-shaped cover 90 which is screwedly mounted onto base 34. The cover 90 has an elongate, substantially rectangularly-shaped base wall 91, a pair of elongate substantially rectangularly-shaped side walls 92, 93, and a pair of end walls 94, 95. The plurality of brushes 50 mounted in base 34 extend through a plurality of openings 96 included in cover 90. A gasket 97 lies between the cover 90 and base 34 to prevent fluid from leaking out of the moistener 20 at the intersection of the cover 90 and base 34.

The forwardly disposed section 100 of the cover 90 has a pair of substantially rectangularly-shaped and oppositely-spaced side walls 101, 102 and a pair of substantially rectangularly-shaped and oppositely spaced end walls 103, 104. The side walls 101, 102 and end walls 103, 104 extend angularly downward from the cover 90 to define a substantially rectangularly-shaped fluid inlet opening 106 in fluid-flow communication with well 80. An arrow 105 molded into end wall 103 of the cover 90 visually indicates to the mailing machine's operator the appropriate opening 106 to fill the base 34 with moistening fluid.

Referring to FIG. 5, the moistener 20 includes a substantially rectangularly-shaped shield 110 rotatably mounted onto a shaft 111. The shield 110, which is preferably made of a stainless steel, has a plurality of fingers 112 which extend substantially horizontally between the plurality of brushes 50. In order to hold the shield 110 in its home position, a substantially horizontal direction, a spring 113 is secured to the cover base wall 91. The spring 113 has a free end 114 which engages at least one of the plurality of fingers 112 of the shield 110 thereby upwardly biasing the shield 110. The moistener 20 includes means for holding the shield 110 so that it will not rotate past 180°. In a preferred embodiment, a tang 115 attached to the rearmost portion 116 of the shield 110 prevents the shield 110 from rotating past 180°. Alternatively, the feed deck 30 may overlap the forwardmost portion 117 of the shield 110 thereby preventing the shield 110 from rotating past 180°. The feed deck 30 also guards the envelope leading edge 25 so that the envelope 29 does not inadvertently feed below the shield 110.

Figure 7:
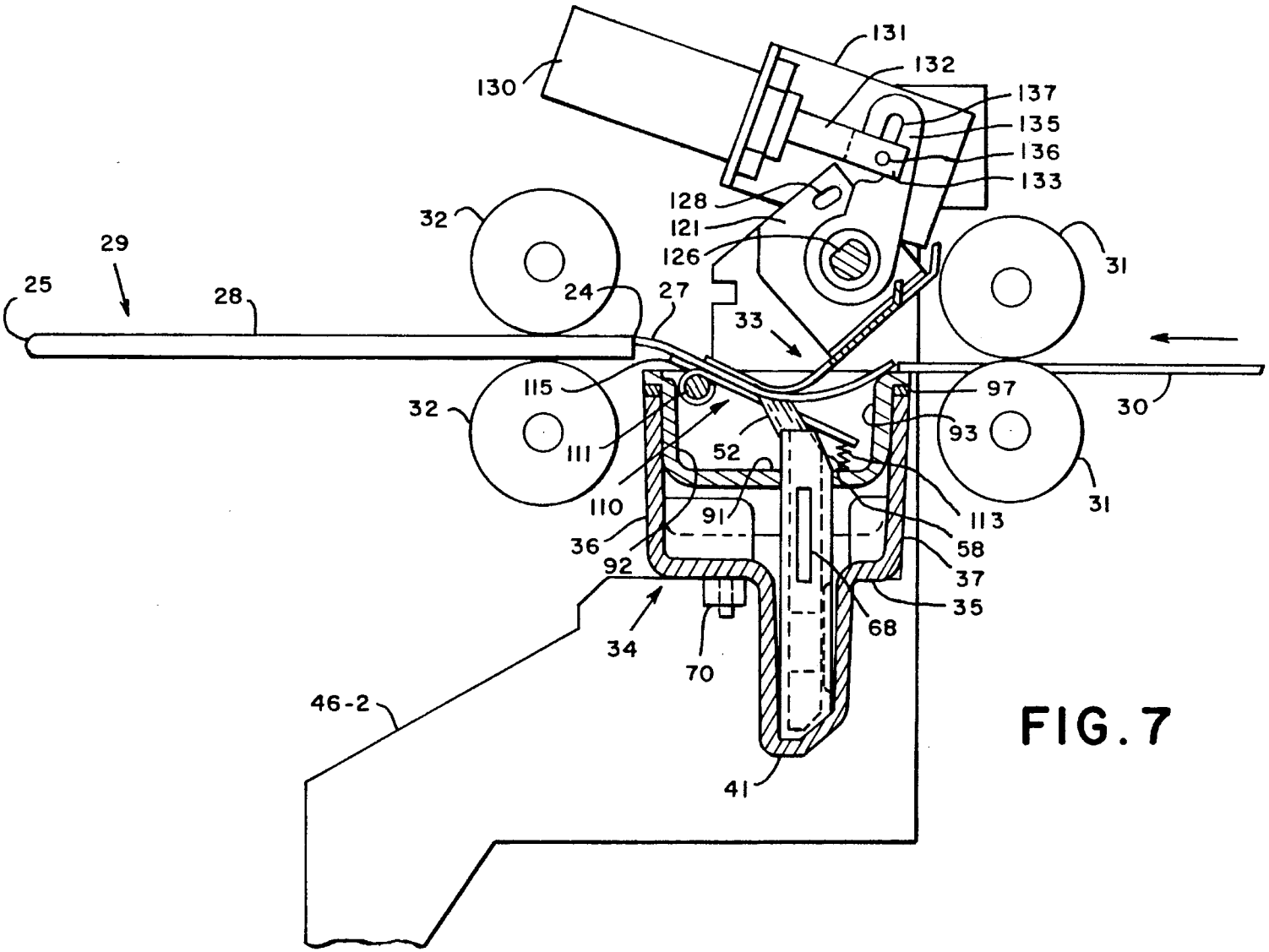
FIG. 7 is a side elevational view of the envelope flap moistening device showing the deflector in the moistening position.

Whether or not an envelope flap 27 contacts the plurality of brushes 50 in order to be moistened is determined by the positioning of a substantially rectangularly-shaped deflector 33 pivotable between a lowered position (see FIG. 7) and home position, a substantially horizontal direction (See FIG. 2). In home position, the deflector 33 is parallel to shield 110 and is disposed approximately 0.5" above shield 110. The deflector 33, which is preferably made of a stainless steel, has a plurality s of fingers 124 interconnected by a continuous edge bar 125, a curvedly-extending guide 119 for guiding the envelope 29 beneath the deflector 33, and a pair of side walls 120, 121. The deflector fingers 124 substantially match the fingers 112 of the shield 110 below. Each side wall 120, 121 has an aperture 122, 123 for receiving D-shaft 126. The shaft 126 extends o through apertures 122, 123 and is rotatably mounted onto the frame 46 using a twist lock bearing 127. If a mailing machine 1 does not have a moistening apparatus 20, the deflector 33 is maintained in home position (see FIG. 2) by engaging a screw (not shown) in aperture 128 to secure the deflector 33 to frame 46 in a substantially horizontal position.

For rotating shaft 126, the moistener 20 includes a conventional solenoid 130 suitably mounted onto L-shaped bracket 131 which is attached to frame 46. The solenoid 130 includes a plunger 132 which preferably includes an outer, yoke-shaped end portion 133 having an aperture 134 formed transversely therethrough. For rotating shaft 126, the moistener 20 further includes upwardly oriented leg 135. In addition, leg 135 preferably includes an elongate, uprightly oriented slot 137 formed therein. The solenoid plungers' end portion 133 is conventionally connected to the upwardly oriented leg 135 by means of a suitable pin 136. The pin 136 extends through the aperture 134 and through slot 137 in a manner such that the solenoid plunger 132 and the upwardly oriented leg 135 are movable relative to one another.

In operation, when an envelope 29 is fed to the moistener for moistening, the gummed strip of material 140 affixed to the interior of the envelope flap 27 is faced downward and is exposed for moistening purposes. As the envelope 29 is further fed downstream, the envelope body 28 is fed onto shield 110. When the fold line 24 lies substantially above the brushes 50, the solenoid 130 is electrically activated. The solenoid plunger 132 is retracted thereby pivoting the deflector 33. The deflector 33 rotates about 45° counterclockwise thereby contacting the envelope 29 and causing the shield 110 to rotate about 24° clockwise against an upwardly directed force exerted by the spring 113. As the shield 110 rotates, the fingers 112 of the shield 110 remain between the brushes 50. The deflector 33 rotates downward contacting the flap 27 and pinching the flap 27 between the deflector 33 and the shield 110, causing the flap 27 to curl within the cover 90 thereby exposing the gummed strip 140 to the bristles 52. The continuous edge bar 125 of the deflector 33 holds the envelope flap 27 into engagement with the bristles 52. Without the edge bar 125, the envelope 29, particularly an envelope with a V-shaped flap, could possibly lose contact with the outermost brush segments 141. The envelope 29 is then pulled away from the moistener 20 by envelope transport 32. If overmoistening occurs, the machine operator may manually select an option to delay actuating the solenoid 130 to moisten less area of the envelope flap 27. When electrical operation of the solenoid 130 is discontinued, the deflector 33 returns back to the home position and the energy in the spring 113 causes the shield 110 to pivot counterclockwise and return to the home position.

Alternatively, in operation, when an open envelope 29 is fed to the moistener 20 without moistening the flap 27, the solenoid 130 is never energized. In this mode of operation, the shield 110 protects the envelope flap 27 from contacting the bristles 52. Furthermore, the deflector 33 in its home position does not contact the envelope. The shield fingers 112, in particular, prevent diagonal envelope flap shapes from contacting the bristles 52 on the flap's apex 142.

Inasmuch as certain changes may be made in the above described invention without departing from the spirit and scope of the same, it is intended that all matter contained in the above description or shown in the accompanying drawings shall be interpreted in an illustrative rather than limiting sense. And, it is intended that the following claims be interpreted to cover all the generic and specific features of the invention herein described.

What is claimed is:

1. An apparatus for applying moisture to an article, comprising:

a frame;

an elongate substantially rectangular-shaped base removably connected to the frame, the base having a plurality of pockets located at spaced intervals longitudinally across the base, the base having a fluid outlet aperture;

a plurality of brushes disposed upwardly for transferring fluid by capillary action, the plurality of brushes including means for slidably engaging the plurality of brushes within the plurality of pockets located in the base;

a cover mounted onto the base, the cover having a fluid inlet aperture, the cover having a plurality of openings for exposing the plurality of brushes, the cover including a substantially horizontal first shaft extending longitudinally across the cover;

a shield rotatably mounted onto the first shaft, the shield having a first plurality of fingers which extend substantially horizontally between the plurality of brushes;

holding means for holding the shield in a substantially horizontal position;

a substantially rectangular-shaped deflector disposed above the shield, the deflector having a second plurality of fingers interconnected by an edge bar, the deflector having oppositely-spaced end walls, each end wall having an aperture;

rotating means coupled to said deflector for rotating the deflector towards the shield; and, a second shaft extending through the aperture in each end wall, the second shaft is rotatably mounted onto the frame.

2. The apparatus according to claim 1 further comprising an overflow reservoir removably slidably connected to the frame, the reservoir located below the fluid outlet aperture.

3. The apparatus according to claim 2 including detecting means coupled to said base for detecting low fluid level.

4. The apparatus according to claim 1 wherein the holding means is a spring having an end attached to the cover, the spring further having a free end for upwardly biasing the shield.

5. The apparatus according to claim 4 further comprising a first tang which abuts the cover and a second tang which engages the shield whereby the shield is allowed to rotate up to about 180°.

6. The apparatus according to claim 4 further comprising a deck overlapping the first plurality of fingers whereby the shield is allowed to rotate up to about 180°.

7. The apparatus according to claim 1 wherein the deflector includes a curvedly-extending guide for guiding the article between the shield and the deflector.

8. The apparatus according to claim 1 wherein the rotating means comprises a substantially L-shaped bracket fixedly mounted to the frame;

a solenoid attached to the bracket; and, an arm rotatably mounted onto the second shaft, the arm having a slot for engaging the solenoid.

9. A kit for applying moisture to an article, comprising:

an elongate substantially rectangular-shaped base, the base having a plurality of pockets located at spaced intervals longitudinally across the base, the base having a fluid outlet aperture;

a plurality of brushes disposed upwardly for transferring fluid by capillary, the plurality of brushes including means for slidably engaging the plurality of brushes within the plurality of pockets located in the base;

a cover mounted onto the base, the cover having a fluid inlet aperture, the cover having a plurality of openings for exposing the plurality of brushes, the cover including a substantially horizontal shaft extending longitudinally across the cover;

a shield rotatably mounted onto the shaft, the shield having a first plurality of fingers which extend substantially horizontally between the plurality of brushes; and holding means coupled to the shaft for holding the shield in a substantially horizontal position.

10. A mailing machine comprising:

a frame;

means connected to the frame for feeding an article;

means for applying moisture to the article including:

an elongate substantially rectangular-shaped base removably connected to the frame, the base having a plurality of pockets located at spaced intervals longitudinally across the base, the base having a fluid outlet aperture;

a plurality of brushes disposed upwardly for transferring fluid by capillary action, the plurality of brushes including means for slidably engaging the plurality of brushes within the plurality of pockets located in the base;

a cover mounted onto the base, the cover having a fluid inlet aperture, the cover having a plurality of openings for exposing the plurality of brushes, the cover including a substantially horizontal first shaft extending longitudinally across the cover;

a shield rotatably mounted onto the first shaft, the shield having a first plurality of fingers which extend substantially horizontally between the plurality of brushes;

holding means coupled to the first shaft for holding the shield in a substantially horizontal position;

a substantially rectangular-shaped deflector disposed above the shield, the deflector having a second plurality of fingers interconnected by an edge bar, the deflector having oppositely-spaced end walls, each end wall having an aperture;

rotating means coupled to the deflector for rotating the deflector towards the shield;

a second shaft extending through the aperture in each end wall, the second shaft is rotatably mounted onto the frame.

11. The mailing machine according to claim 10 further comprising an overflow reservoir removably slidably connected to the frame, the reservoir located below the fluid outlet aperture.

12. The mailing machine according to claim 11 including detecting means coupled to the base for detecting low fluid level.

13. The mailing machine according to claim 10 wherein the holding means is a spring having an end attached to the cover, the spring further having a free end for upwardly biasing the shield.

14. The mailing machine according to claim 13 further comprising a first tang which abuts the cover and a second tang which engages the shield whereby the shield is allowed to rotate up to about 180°.

15. The mailing machine according to claim 13 further comprising a deck overlapping the first plurality of fingers whereby the shield is allowed to rotate up to about 180°.

16. The mailing machine according to claim 10 wherein the deflector includes a curvedly-extending guide for guiding the article therebeneath and into engagement with the shield.

17. The mailing machine according to claim 10 wherein the rotating means comprises a substantially L-shaped bracket fixedly mounted to the frame;

a solenoid attached to the bracket; and, an arm rotatably mounted onto the second shaft, the arm having a slot for engaging the solenoid.

* * * * *